United States Patent [19]

Minoura et al.

[11] 4,274,471

[45] Jun. 23, 1981

[54] PROCESS FOR CONTINUOUS CASTING OF METALS AND AN APPARATUS THEREFOR

[75] Inventors: Michinori Minoura, Nagoya; Nobuo Tsuno, Kasugai, both of Japan

[73] Assignee: NGK Insulators, Ltd., Nagoya, Japan

[21] Appl. No.: 19,591

[22] Filed: Mar. 12, 1979

[30] Foreign Application Priority Data

Mar. 15, 1978 [JP] Japan ..... 53-28753

[51] Int. Cl.[3] ..... B22D 11/06

[52] U.S. Cl. ..... 164/87; 164/428

[58] Field of Search ..... 164/428, 87, 88, 429, 164/432, 433, 434, 89, 443, 133

[56] References Cited

U.S. PATENT DOCUMENTS

| | | | |
|---|---|---|---|
| 2,450,428 | 10/1948 | Hazelett | 164/428 |
| 2,473,221 | 6/1949 | Rossi | 164/89 |
| 3,450,188 | 6/1969 | Vallak et al. | 164/440 |
| 3,710,840 | 1/1973 | Fabens, Jr. | 164/85 |
| 4,086,952 | 5/1978 | Olsson | 164/88 |

FOREIGN PATENT DOCUMENTS

| | | | |
|---|---|---|---|
| 986078 | 7/1951 | France | 164/428 |
| 519977 | 4/1940 | United Kingdom | 164/87 |

OTHER PUBLICATIONS

"The Production of Non-ferrous Metal Slab and Bar by Continuous Casting and Rolling Methods" by D. M. Lewis, Metallurgical Review, 1961, vol. 6, No. 22, pp. 143–192.

*Primary Examiner*—Robert D. Baldwin
*Assistant Examiner*—K. Y. Lin
*Attorney, Agent, or Firm*—Stevens, Davis, Miller & Mosher

[57] ABSTRACT

The invention is used for continuous casting of metals into sheets, wires, bars and the like. Such continuous casting process comprises constituting a roll system with a main roll cooled from the inner portion and a plurality of sub-rolls, said sub-rolls being provided along the outer periphery surface of the main roll by holding a given gap against the main roll, supplying a molten metal into the gap formed by the main roll and the sub-rolls while rotating the main roll and the sub-rolls mutually in a direction carrying with the molten metal, allowing the molten metal to solidify when the molten metal passes through the gap between the main roll and the sub-roll and taking out the solidified metal continuously from said roll system.

11 Claims, 6 Drawing Figures

PROCESS FOR CONTINUOUS CASTING OF METALS AND AN APPARATUS THEREFOR

The present invention relates to a process for casting sheets, wires, bars and the like at a high speed continuously from molten metals, such as various metals or alloys having various compositions and apparatus therefor.

Heretofore, typical continuous casting processes for producing sheets, wires, bars and the like directly from various molten metals include the wheel-and-belt process represented by Properzi process, wherein a casting wheel made of copper or steel, which is provided with a given molding groove along the circumference of the wheel and can be cooled from the inner portion or the outer portion, is covered with a steel belt to form a casting mold between the wheel and the belt and a molten metal is flowed into the casting mold and cooled from the outside to solidify the molten metal, the twin belt process wherein a molten metal is poured into a casting mold formed by two opposite steel belts which move together and the back sides of the belts are cooled with water to solidify the molten metal, the twin roll process wherein a molten metal is poured into V-shaped cavity formed by a pair of oppositely rotating rolls and the molten metal is solidified from the side contacting to the roll and the like.

Among these processes, the wheel-and-belt process is mainly used for the continuous casting of bars or sheets but has the following defects:

(1) The portion of the steel belt where it is most heated and contacts with the molten metal just after casting, cannot be cooled.

(2) The casting metal and the steel belt do not conduct the relative motion, so that metals to be cast are limited to metals having a relatively low melting point, such as aluminum and copper.

(3) Exudation is apt to be caused at the steel belt side of the cast owing to the insufficient cooling.

(4) There is a problem in the durability of the steel belt and the steel belt must be frequently exchanged.

(5) It is impossible to cast a wide sheet due to deformation of the steel belt.

The twin belt process is used for production of sheets but also has the following defects:

(1) There is no relative motion between the cast and the steel belts, so that the durable life of the steel belts is short.

(2) It is difficult to obtain casts having sound surface due to deformation of belts owing to the thermal expansion.

Furthermore, among the twin roll process, in the case where a molten metal is supplied between two rolls from the upper side of the rolls, the cast must be passed through the minimum gap of the rolls in the state where the molten metal is substantially solidified, so that it is important to severely control the position for starting solidification and the cooling condition of roll and the control of the production condition is difficult, and further since the cast has been substantially solidified, the load applied to the rolls is large and therefore strong rolls are necessary. In addition, there is the fear that the rolls stop or the cast ruptures due to a slight variation of the solidifying state and further as mentioned above, the cast is passed through the minimum gap of the rolls after the solidification is substantially completed, so that the production speed is very slow.

Furthermore, among the twin roll process there is the process wherein a molten metal is pulled upwardly by passing through two rolls while solidifying the molten metal. This process has the defect that since the cooling zone of a molten metal is short, the casting speed becomes further lower. In the twin roll process, the contact time of a molten metal and the rolls is short and a more or less reduction is applied to the cast at the minimum gap of the rolls, so that this process can be applied only to metals which are narrow in the range of the solidifying temperature and conduct solidification of the skin formation type.

The process for continuous casting of metals and apparatus therefor according to the present invention has been made in order to obviate all these defects in the conventional continuous casting processes.

The present invention is the process for producing metal sheets having the desired thickness and width, metal wires having the desired diameter and the like from molten metals having various compositions stably and in a high dimension accuracy by a simple apparatus irrelative to the solidifying temperature range and plasticity of metals, and consists in a process for continuous casting of metals, which comprises constituting a roll system with a main roll cooled from the inner portion and a plurality of sub-rolls, said sub-rolls being provided along the outer periphery surface of the main roll by holding a given gap against the main roll, supplying a molten metal into the gap formed by the main roll and the sub-rolls while rotating the main roll and the sub-rolls mutually in a direction carrying with the molten metal, allowing the molten metal to solidify when the molten metal passes through the gap between the main roll and the sub-roll and taking out the solidified metal continuously from said roll system.

The present invention will be explained in more detail.

For a better understanding of the invention, reference is taken to the accompanying drawings, wherein.

Figure 2:
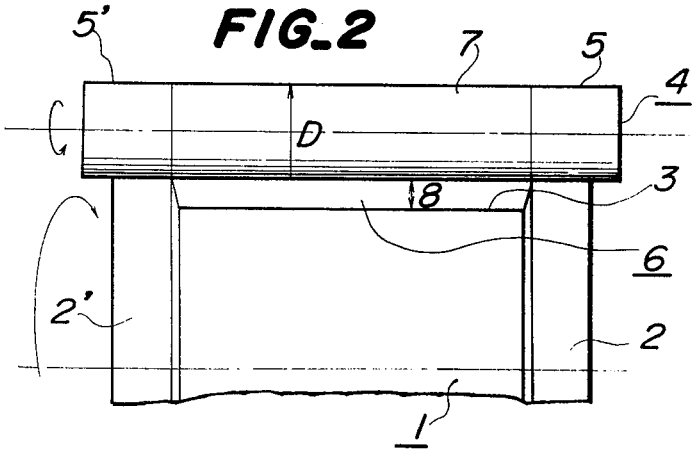
FIG. 2 illustrates a relation between the main roll and the typical one of the sub-roll of an embodiment of an apparatus of the present invention.
Figure 3:
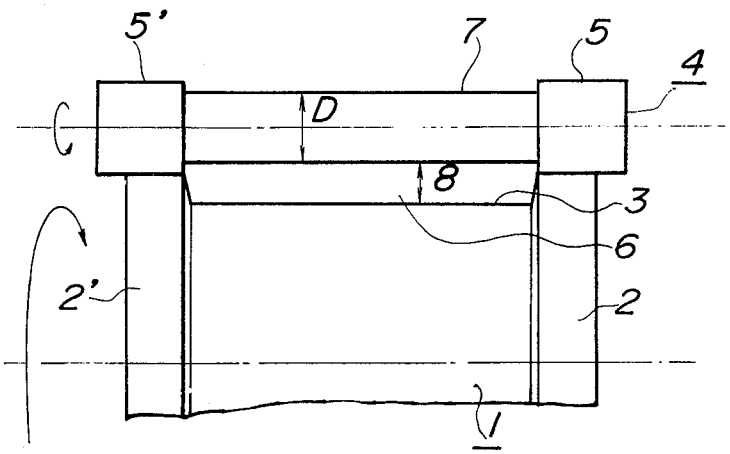
FIG. 3 illustrates a relation between the main roll and the typical one of the sub-roll of another embodiment of an apparatus of the present invention as shown in FIG. 2.

The production process of the present invention will be explained with respect to FIGS. 1 to 3 which show an embodiment of apparatus for producing a sheet cast. Both ends of a main roll 1 made of a metal, such as copper, copper alloy, steel and the like, the surface of which is cooled from the inner portion and which is rotated by a motor 19, are provided with flanges 2 and 2' having a larger diameter than that of the main roll to form a space and a plurality of sub-rolls 4 having a smaller diameter than that of the main roll and composed of a material selected from the group consisting of a refractory, such as graphite, alumina, beryllia, zirconia, boron nitride, silicon carbide and the like, steel, the roll surface of which is coated with a refractory and a metal, such as copper, copper alloy and steel which is cooled from the inner portion are provided along the flanges 2 and 2' of the main roll 1. The outer periphery surfaces 5 and 5' at both ends of the sub-roll 4 are in contact with the flanges 2 and 2' respectively and the main roll and the sub-rolls are rotated mutually in the direction carrying with a molten metal.

In general, the sub-rolls 4 are in contact with the flanges of the main roll with compression or tensile force of action of spring (not shown) but the sub-rolls in the zone where the solidification of the molten metal is completed, are preferably fixed by screws (not shown) in view of stabilization of formation of the solidified shell.

A molding space 6 where the molten metal is cast, is surrounded with a groove 3 of the main roll 1 and the sub-roll 4 and therefore the cast 13 is obtained as a continuous body having the maximum cross-section corresponding to the molding space 6. The adjustment of roll gap 8 between the groove 3 of the main roll 1 and the outer periphery surface 7 of each sub-roll 4 opposing to the groove 3 of the main roll, which defines the thickness of the cast 13 is important in view of production of the sound cast and it is desirable that the roll gap 8 formed by the outer periphery surface 7 of the sub-roll provided at the position where the solidification of the molten metal is completed or at the position where is just after the solidification of the molten metal is completed, that is the sub-roll having the possibility that the solidified cast is applied to reduction, is not larger than the roll gap 8 formed by the outer periphery surface 7 of the next and following sub-rolls and the groove 3 of the main roll. For example, in FIG. 1, when the solidification of the molten metal is completed at the first sub-roll 4*a*, it is desirable that the roll gap 8*a* formed by the outer periphery surface 7 of the first sub-roll 4*a* and the groove 3 of the main roll 1 is equal to or smaller than the roll gaps 8*bi* (i=1, 2, . . . , n) formed by the outer periphery surfaces 7 of the next and following sub-rolls 4*bi* (i=1, 2, . . . , n) and the groove 3 of the main roll 1. The adjustment of the roll gaps 8*bi* (i=1, 2, . . . , n) can be easily adjusted by varying the diameter D of the sub-roll 4 opposing to the groove 3 of the main roll 1 as shown in FIG. 3.

Figure 6:
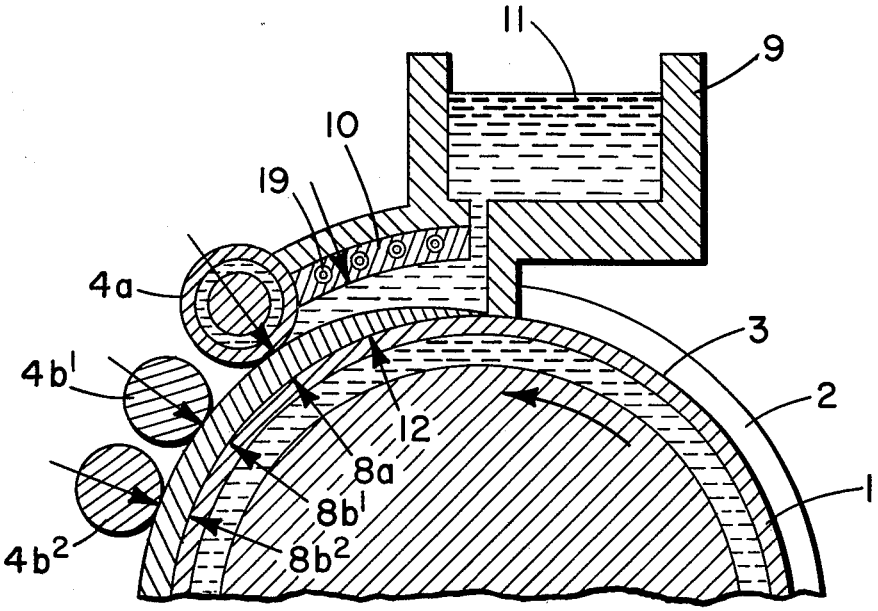
FIG. 6 is a view similar to that of FIG. 1 showing use of a heating means.

The molten metal 11 is fed to the roll gap 8*a* formed by the outer periphery surface 7 of the first sub-roll 4*a* and the groove 3 of the main roll 1 through tunnel 10 from a molten metal source, such as a tundish 9. The tunnel 10 prevents dissipation of heat from the molten metal surface at the sub-roll side at the section between the position where the molten metal falls down to the groove 3 of the main roll 1, and the sub-roll 4*a*, whereby the molten metal is passed through the tunnel smoothly and the molten metal in the tunnel can be solidified in one direction from the main roll surface and further the variation of the cross-sectional dimension, which disturbs the stable growth of the solidified shell from the main roll surface side, is restrained. Accordingly, it is necessary that the material of the tunnel 10 is high in the heat insulating property and it is preferable to use fiber shaped articles of alumina, alumina-silica, zirconia and the other refractories or heat resisting materials, but it is possible to use heat resistant materials heated by any heating means 19 as illustrated in FIG. 6. The height 12 of the stream way of the molten metal in the tunnel is preferred to be larger than the gap 8*a* formed by the outer periphery surface 7 of the first sub-roll 4*a* and the main roll 1 in order to make the formation of the solidified shell owing to the outer periphery surface 7 of the first sub-roll 4*a* easy.

That is, the molten metal poured from the tundish 9 to the roll system wherein the main roll 1 and a plurality of sub-rolls 4 arranged along the outer periphery surface of the main roll 1 are mutually rotated in a direction carrying with the molten metal, starts solidification in the tunnel 10 in one direction from the surface contacting to the main roll 1 cooled from the inner portion and increases the thickness of the solidified shell as the molten metal approaches the first sub-roll 4*a* and at the stage when the molten metal passes through the gap 8*a* formed by the outer periphery surface 7 of the first sub-roll 4*a* and the groove 3 of the main roll 1, the unsolidified layer slightly remaining at the side contacting to the first sub-roll 4*a* finishes the solidification by contacting to the first sub-roll 4*a* or forms the solidified shell having a strength which is not ruptured by the pressure of the molten metal after passing through the gap 8*a*. If the sub-rolls lying in the region from the first sub-roll to the sub-roll at which the solidification of the casting metal is finished are constructed such that the sub-roll(s) is cooled from the inner portion as in the main roll, even when a swelling (inflation, expansion) occurs on the cast 13 passed through the first sub-roll 4*a* at the sub-roll 4 side owing to the pressure of the molten metal, such a swelled surface is flattened and smoothened, and cooled by the second and following sub-rolls 4*bi* (i=1, 2, . . . n), accordingly the cast having a given dimension accuracy and strength can be obtained.

Furthermore, it is desirable that the roll gap 8 formed by the outer periphery surface 7 of the sub-roll at the position where the solidification of the casting metal is finished or at the position which is just after the solidification is finished, that is the sub-roll having the possibility that a compression is subjected to the solidified cast, and the groove 3 of the main roll, is not larger than the roll gaps 8 formed by the outer periphery surface 7 of the next and following sub-rolls and the groove 3 of the main roll. This is because when the former gap is larger than the latter gap, the cast 13 which has been already compressed when passing through the broader roll gap 8 and has a higher running speed than the peripheral speed of the main roll, is fed into the roll gap 8 which is smaller than the thickness of the cast and as the result the cast cannot pass through the roll gap and therefore the stable continuous casting will become unfeasible.

The molten metal 11 is substantially completely solidified by passing through the roll gaps 8 formed by the plurality of sub-rolls 4 and the main roll 1 and is increased fully in the strength and then is continuously taken out from the roll system as the cast 13 and cut in the given size or wound up into a coil or directly rolled.

The material quality, diameter and width of the main roll 1, and the material quality, diameter, width, number, position, interval and driving mechanism of the sub-rolls may be selected depending upon the kind of metals to be cast, the casting temperature, the cross-sectional shape and size of the continuous cast, the production rate and the like, but in general, the material of the main roll surface, when the cross-sectional size of the cast is large, the melting point is high, the solidifying temperature range is broad, the thermal conductivity is low, or the solidification speed is low, is preferred to be copper or copper alloy having a high thermal conductivity and it is important in view of obtaining the sound cast that the material quality of the sub-rolls is those which form the solidified shell on the cast metal immediately at the outlet of the tunnel 10 and solidify the molten metal as soon as possible, so that the sub-rolls at the section between the second roll and the sub-roll where the casting metal is solidified, as well as the first sub-roll are preferred to be metal rolls cooled from the inner portion. And, it is preferred in view of operation to make the diameter of the main roll as large as possible and to make the diameter of the sub-rolls as small as possible to make the mutual interval of the sub-rolls as small as possible.

Figure 4:
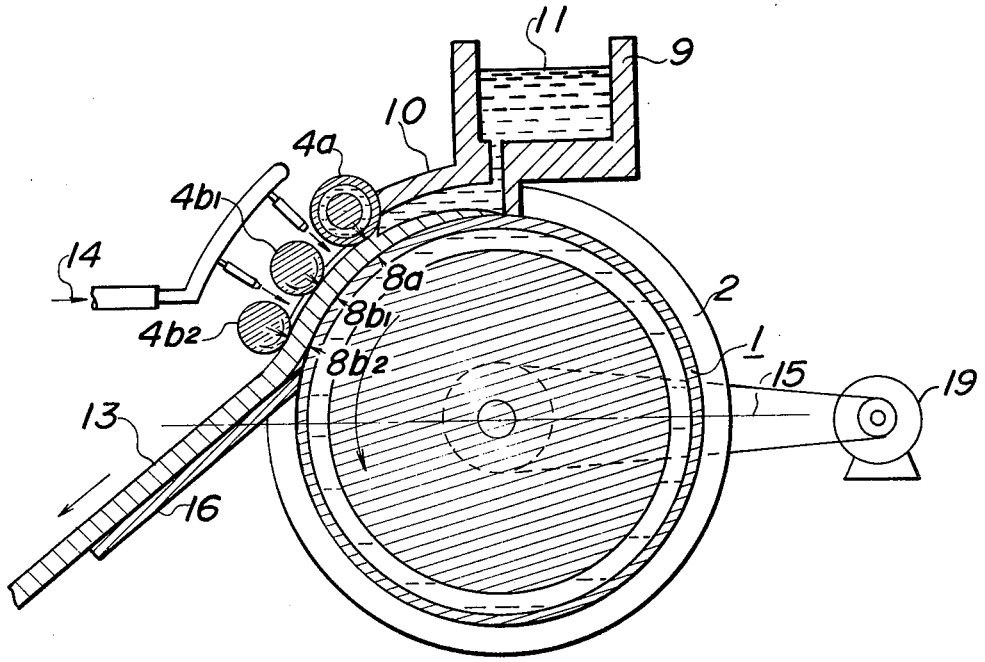
FIG. 4 is a schematic sectional view of a modified embodiment of the apparatus for carrying out the process according to the present invention.

Furthermore, when the roll system is made to be small, a cast having a large cross-sectional dimension is produced or the growing velocity of the solidified shell of the casting metal is slow, as shown in FIG. 4, a proper cooling medium 14 may be sprayed towards the casting metal from between the mutual sub-rolls to promote the cooling. Furthermore, as shown in FIG. 4, it is possible to make the position for taking out the cast 13 more upper than the horizontal axis line 15 of the main roll and to take out the cast along a guide plate 16.

Figure 5:
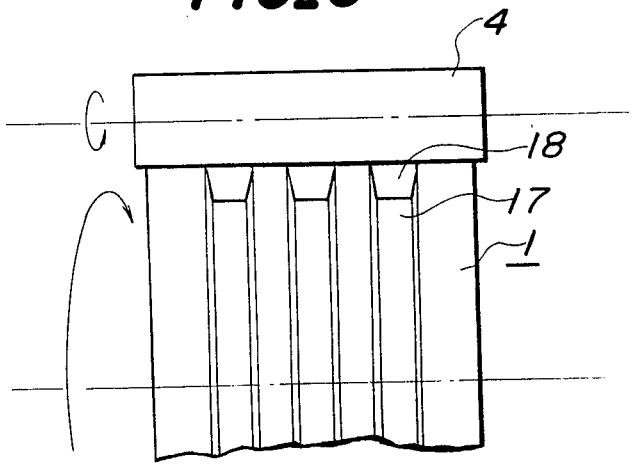
FIG. 5 illustrates a relation between the main roll having three grooves on the roll surface and the typical one of the sub-roll of a further embodiment of an apparatus of the present invention.

Moreover, in the process and apparatus according to the present invention, as shown in FIG. 5, desired shaped grooves are provided on the outer periphery surface of the main roll, the main roll 1 and the sub-rolls 4 are rotated by mutually closely contacting the plain portion of the outer periphery surface of the main roll with the outer periphery surface of the sub-rolls 4, a molten metal is supplied to the casting spaces 18 having the desired shape, which are surrounded by the grooves 17 of the main roll 1 and the outer periphery surface of the sub-rolls 4, from a tundish through a tunnel passing to the molding spaces 18 and bars or wires having the desired cross-sectional shape are produced.

The following examples are given for the purpose of illustration of this invention and are not intended as limitations thereof.

EXAMPLES

Figure 1:
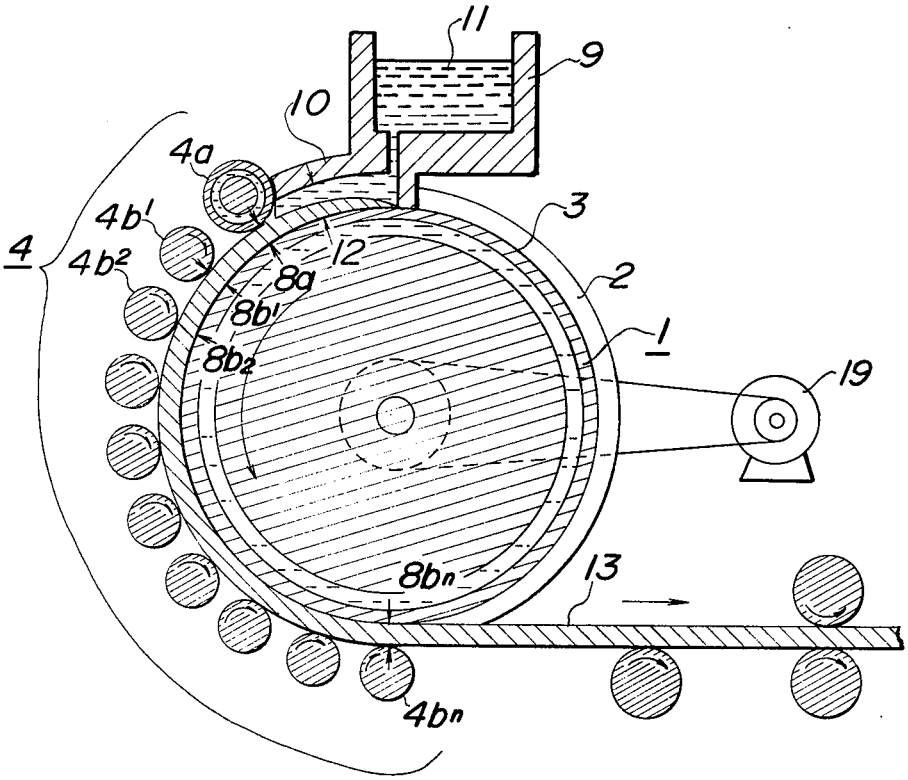
FIG. 1 is a schematic sectional view of an embodiment of the apparatus for carrying out the process according to the present invention.

Both ends of a copper ring having an outer diameter of 300 mm, a width of 60 mm and a wall thickness of 10 mm were provided with carbon steel flanges having an outer diameter of 304 mm or 306 mm and a thickness of 10 mm to constitute a groove of a width of 60 mm and a depth of 2 mm or 3 mm, and a main roll in which cooling water fed from one side of the roll axis flows the inner surface of the copper ring spirally and is discharged from another roll axis, the first copper sub-roll having a diameter of 50 mm and capable of being water cooled from the inner portion and the additional nine sub-rolls from the second sub-roll to the tenth sub-roll, which are made of graphite, have a diameter of 30 mm and are arranged as shown in FIG. 1, said sub-rolls being contacted with the flanges of the main roll, were arranged to maintain the roll gaps as shown in following Table respectively to constitute the roll systems as shown in FIG. 1.

The first sub-roll was fixed with screws for adjusting the roll gap so that the first sub-roll positions at 27.5° in the counterclockwise direction from the top of the main roll and the outer periphery surface of said sub-roll can rotate in contact with the flanges of the main roll and the nine sub-rolls from the second sub-roll to the tenth sub-roll were held by applying the tensile force to the axial direction of the main roll by means of springs, so that the outer periphery surfaces of said sub-rolls are in tight contact with the flanges of the main roll respectively. The temperature of cooling water in the main roll and the first sub-roll was adjusted to be 30° C. The tunnel was made of alumina fiber shaped article. In the casting of molten metals by using this continuous casting apparatus, the conditions were selected so that the solidification of the molten metals is finished when molten metals pass through the first sub-roll.

The conditions and results when the continuous casting was carried out with respect to various metals are shown in Table.

Furthermore, the roll surface was made of carbon steel ring and the diameter of said roll and the flanges were made to be 300 mm and the other structure was the same as in the above described main roll. Two rolls having such a structure were arranged in the horizontal direction and molten metals were poured into V-shaped cavity between said two rolls (so-called "twin roll process"). This experiment was carried out as the comparative examples and the conditions and the results also are shown in the following Table.

TABLE

| | | | Continuous casting conditions | | | | | Results of continuous casting | | |
|---|---|---|---|---|---|---|---|---|---|---|
| | | | | | | Gap formed by main roll and sub-roll (mm) | | | | |
| Example | No. | Metals | Depth of groove in main roll (mm) | Casting temperature (°C.) | Casting speed (m/min) | 1st roll | 2nd–10th rolls | Continuity of cast sheet | Lateral rupture | Average sheet thickness (mm) |
| Example | 1 | Cu-2.0Be | 2.0 | 1,020 | 21 | 2.0 | 2.3 | continuous | no | 2.06 |
| | 2 | Al-5.0Cu | 2.0 | 700 | 21 | 2.0 | 2.3 | continuous | no | 2.02 |
| | 3 | cast iron | 2.0 | 1,200 | 23 | 2.0 | 2.3 | continuous | no | 2.08 |
| | 4 | copper | 2.0 | 1,100 | 28 | 2.0 | 2.3 | continuous | no | 2.04 |
| | 5 | aluminum | 2.0 | 700 | 21 | 2.0 | 2.3 | continuous | no | 2.02 |
| | 6 | Cu-2.0Be | 3.0 | 1,020 | 9 | 3.0 | 3.3 | continuous | no | 3.07 |
| | 7 | Al-5.0Cu | 3.0 | 700 | 9 | 3.0 | 3.3 | continuous | no | 3.02 |
| | 8 | cast iron | 3.0 | 1,200 | 10 | 3.0 | 3.3 | continuous | no | 3.06 |
| | 9 | copper | 3.0 | 1,100 | 13 | 3.0 | 3.3 | continuous | no | 3.05 |
| | 10 | aluminum | 3.0 | 700 | 9 | 3.0 | 3.3 | continuous | no | 3.02 |
| Prior art | 11 | Cu-2.0Be | — | 990 | 14 | roll gap | 2.0 | non-continuous | many | — |
| | 12 | Al-5.0Cu | — | 700 | 12 | roll gap | 2.0 | non-continuous | many | — |
| | 13 | cast iron | — | 1,200 | 3 | roll gap | 2.0 | non-continuous | many | — |
| | 14 | aluminum | — | 700 | 12 | roll gap | 2.0 | continuous | few | 2.53 |
| | 15 | Cu-2.0Be | — | 990 | 7 | roll gap | 3.0 | non-continuous | many | — |
| | 16 | Al-5.0Cu | — | 700 | 6 | roll gap | 3.0 | continuous | many | — |
| | 17 | cast iron | — | 1,200 | 2 | roll gap | 3.0 | non-continuous | many | — |

TABLE-continued

| | | | Continuous casting conditions | | | | | Results of continuous casting | | |
|---|---|---|---|---|---|---|---|---|---|---|
| | | | Depth of groove in main roll | Casting tempera-ture | Casting speed | Gap formed by main roll and sub-roll (mm) | | | | Average sheet |
| Example | No. | Metals | (mm) | (°C.) | (m/min) | 1st roll | 2nd–10th rolls | Continuity of cast sheet | Lateral rupture | thickness (mm) |
| | 18 | aluminum | — | 700 | 6 | roll gap | 3.0 | continuous | few | 3.85 |

As seen from the results of the above Table, according to the casting process and the apparatus of the present invention, alloys having various compositions and broad ranges of solidification temperatures, as well as pure metals can be continuously cast at a high speed and further the casts having a thin thickness can be obtained by the continuous casting.

Examples disclosed in the above table do not limit the dimension of the casts capable of being produced by the process and apparatus of the present invention and when the diameter of the main roll and the roll gap formed by the groove in the outer periphery surface of the main roll and the sub-rolls is made to be larger, thicker sheets can be continuous cast without lowering the casting speed.

As mentioned above, according to the process for continuous casting of metals of the present invention and the apparatus therefor, the molten metal supplied to the main roll from the tundish solidifies from the main roll surface side and the unsolidified metal remaining at the sub-roll side starts solidification from the time when said metal contacts with the first sub-roll and the cast is held along the main roll surface by the plurality of sub-rolls until the cast provides the desired strength, and no large deformation is applied to the cast for the time, so that the stable continuous cast can be obtained without regard to the thickness of the cast and the broadness of the range of the solidification temperature. When the metal cast to the main roll surface is fed in contact with the main roll surface, said metal is held by the plurality of sub-rolls and the sub-rolls always conduct the relative motion against the cast metal and the sub-rolls themselves can be easily made to be high in strength and can cool efficiently, so that the sub-rolls are not deformed by heat or mechanical stress. Accordingly, the dimension accuracy of the cast is high and it is possible to make the width of the roll larger to obtain the cast sheets having a large width or to produce a large number of cast bars simultaneously.

Furthermore, according to the process and the apparatus of the present invention, by selecting the diameter and width of the main roll and the sub-rolls, the shape of the recess in the main roll and the sub-rolls, the roll gap formed by the sub-roll surface and the main roll surface, the material of the main roll and the sub-rolls, the revolution velocity of the main roll and the like depending upon the broadness of the range of the solidification temperature of metals and the shape and dimension of the aimed casts, the desired sheet-shaped or bar-shaped casts can be commercially and easily produced at a faster speed than the conventional speed by a simple apparatus. The present invention can be utilized as the process and apparatus for producing intermediate products for materials which need a large number of working steps, such as thin sheets for spring, metal foils, metal wire and the like, and as the process and apparatus for producing sheets and wires of non-plastic cast iron, magnetic alloys, intermetallic compounds and the like and is commercially very useful.

What is claimed is:

1. A process for continuous casting of metals which comprises forming a roll system with a main roll cooled from the inner portion and a plurality of sub-rolls, said sub-rolls being provided along the outer periphery surface of the main roll forming and holding a given gap against the main roll, supplying a molten metal into the gap formed by the main roll and the sub-rolls while rotating the main roll and the sub-rolls mutually in a direction carrying with the molten metal, covering the flow path of the molten metal from a molten metal source to a first sub-roll with a tunnel made of a heat resistant material, said tunnel preventing dissipation of heat from the molten metal surface at the tunnel side at the section between the position where the molten metal falls down to the main roll and the first sub-roll, initiating solidification of said molten metal in said tunnel, said molten metal passing through the tunnel smoothly and increasingly solidifying in one direction from the main roll surface as it passes through said tunnel, said tunnel restraining variations of the cross-sectional dimension of the molten metal, which disturbs the stable growth of the solidified shell from the main roll surface side, completing solidification of said molten metal at said sub-rolls, and taking the solidified metal continuously from said roll system.

2. The process as claimed in claim 1, wherein the tunnel is heated by a heating means.

3. The process as claimed in claim 1, wherein the heat resisting material is a ceramic fiber.

4. The process as claimed in claim 1, 2 or 3, wherein at least one sub-roll is cooled from the inner portion.

5. The process as claimed in claim 1, 2, 3 or 4, wherein a cooling medium is sprayed towards the casting metal from respective spaces between a plurality of sub-rolls to promote the cooling of the cast passing through the gaps between the main roll and the sub-rolls.

6. An apparatus for continuous casting of metals, which comprises a roll system including a main roll having a large diameter and capable of being cooled from the inner portion and a plurality of sub-rolls, said sub-rolls being arranged along the outer periphery surface of the main roll, forming and holding a given gap against the main roll, means for driving said roll system, means for cooling the main roll, means for supplying a molten metal to a gap formed by the main roll and the sub-rolls, and a tunnel which is made of a heat resisting material and covers the flow path of the molten metal from a molten metal source to a first sub-roll, said tunnel preventing dissipation of heat from the molten metal surface at the tunnel side at the section between the position where the molten metal falls down to the main roll and the first sub-roll, said tunnel and main roll causing initiation and increasing solidification of molten metal passing through said tunnel, said tunnel causing smooth passage of molten metal therethrough, said molten metal in the tunnel solidifying in one direction from the main roll surface, said tunnel restraining variations of the cross-sectional dimension of the molten metal, which disturbs the stable growth of the solidified shell from the main roll surface side and preventing complete solidification of said molten metal therein, said sub-rolls completing solidification of said molten metal.

7. The apparatus as claimed in claim 6, wherein the tunnel is heated by a heating means.

8. The apparatus as claimed in claim 6 or 7, wherein at least one sub-roll is cooled from the inner portion.

9. The apparatus as claimed in claim 6, 7 or 8, which is provided with means by which a cooling medium is sprayed towards the casting metal from respective spaces between a plurality of sub-rolls.

10. The apparatus as claimed in claim 6, wherein said main roll is provided with a pair of flanges having a larger diameter than that of the main roll at both ends to form a groove by the main roll and the flanges and said flanges are in contact with the sub-rolls to form a cast molding space.

11. The apparatus as claimed in claim 10, wherein the roll gap formed by the groove of the main roll and the periphery surface of the sub-roll at the position where the solidification of the molten metal is finished or at the position which lies just after solidification of the molten metal, is equal to or smaller than the gaps formed by the groove of the main roll and the periphery surface of the next and following sub-rolls.

* * * * *